US010116068B1

(12) United States Patent
Tang

(10) Patent No.: US 10,116,068 B1
(45) Date of Patent: Oct. 30, 2018

(54) BONDING BLOCK WITH ROTATABLE COMPRESSION GROUND CONTACT

(71) Applicant: ANTRONIX INC., Cranbury, NJ (US)

(72) Inventor: Neil Tang, Princeton, NJ (US)

(73) Assignee: ANTRONIX INC., Cranbury, NJ (US)

( * ) Notice: Subject to any disclaimer, the term of this patent is extended or adjusted under 35 U.S.C. 154(b) by 0 days.

(21) Appl. No.: 15/668,863

(22) Filed: Aug. 4, 2017

(51) Int. Cl.
*H01R 4/66* (2006.01)
*H01R 4/36* (2006.01)

(52) U.S. Cl.
CPC ..... *H01R 4/366* (2013.01)

(58) Field of Classification Search
CPC ..... H01R 4/30; H01R 9/0512
USPC ..... 439/97, 98, 100, 812, 813
See application file for complete search history.

(56) References Cited

U.S. PATENT DOCUMENTS 1,535,694 A * 4/1925 Smith ..... H01R 4/32 439/812
3,086,194 A * 4/1963 Price ..... H01R 4/363 439/812
5,553,787 A 9/1996 Guginsky
6,099,344 A * 8/2000 Chadbourne ..... H01R 4/2483 439/416
6,339,190 B1 1/2002 Chung
D487,427 S 3/2004 Franks, Jr.
7,029,293 B2 * 4/2006 Shapson ..... H01R 4/363 439/812
7,198,495 B1 4/2007 Youtsey
7,798,869 B1 * 9/2010 Konopacki ..... H01R 4/363 439/812

OTHER PUBLICATIONS

Signal Vision Inc., Signal Vision 1 GHz Bonding Block, Model SV-GB-1G, advertisement, Lake Forest, California.

* cited by examiner

*Primary Examiner* — Phuong Dinh
(74) *Attorney, Agent, or Firm* — Volpe and Koenig, P.C.

(57) ABSTRACT

A bonding block has a block body configured to be secured to a structure, a threaded hole extending in an axial direction, and a ground wire channel extending through the threaded hole in a direction perpendicular to the axial direction. The bonding block also has a screw assembly having a screw and a contacting element having a substantially flat first contact surface. The contacting element is rotatable relative to the screw such that the contacting element traverses axially without rotating while the screw is tightened in the threaded hole. The block body has a substantially flat second contact surface positioned at a bottom of the threaded hole and the ground wire channel. The screw assembly compresses a ground wire extending through the ground wire channel between the first contact surface and the second contact surface as the screw is tightened in the threaded hole.

18 Claims, 3 Drawing Sheets

BONDING BLOCK WITH ROTATABLE COMPRESSION GROUND CONTACT

FIELD OF INVENTION

The present invention relates to electrical connectors having ground contacts, and, more particularly, to a bonding block having a rotatable compression ground contact.

BACKGROUND

There are many different types of electrical connectors which connect the various systems that are used every day. An important aspect of many electrical connections (and any conductor potentially exposed to electricity) is the manner in which the electrical conductor is grounded. Grounding of a conductor is a safety feature which directs high voltage and/or high current to ground in abnormal situations, such as lighting strikes or power surges.

Coaxial cable is an electrical connector which is generally used to carry only low voltage and current RF signals. For example, coaxial cables are commonly used to provide communication signals (e.g., CATV) to homes and businesses. Complex networks of coaxial cables are run throughout cities and neighborhoods everywhere. Even though these cables generally carry only low-voltage signals, there is the possibility of exposure to high-voltage and/or high current conditions (e.g., due to a lighting strike). Therefore, coaxial cables are often grounded at various locations along their span.

One device for grounding a coaxial cable is a bonding block. An electrical bonding block is attached to a building or other structure in order to connect and ground the conductive wire of a coaxial cable. An example of an electrical bonding block is found in U.S. Pat. No. 7,198,495 ("the '495 Patent"). Electrical bonding blocks, including that of the '495 Patent, include coaxial cable connectors which connect one or more pairs of coaxial cables in series. The bonding block essentially interrupts the coaxial cable and connects the conductive shield or conductive wire of the coaxial cable to a ground wire. Typically, the ground wire is passed through an opening in the bonding block and a screw is tightened against the ground wire to form an electrical connection to ground. This conventional configuration suffers from some drawbacks, however, because the grounding screw produces only a small contact area which may damage the ground wire and/or create an unreliable connection.

There have been some attempts to increase the contact area of the screw with the ground wire by including an additional component which is connected to the screw. For example, the '495 Patent describes an embodiment which includes a movable wedge which contacts the ground wire. These solutions have some drawbacks, however, because they require the attachment of a separate piece to the screw when the screw is already in the bonding block. This could complicate the assembly process by requiring an additional step after the screw is inserted and produces the potential for the separate piece to be dropped or become lost.

The present disclosure is directed to overcoming these and other problems associated with prior ground contacts.

SUMMARY

In one aspect, the present disclosure is directed to a bonding block. The bonding block includes a block body configured to be secured to a structure, a threaded hole extending in an axial direction, and a ground wire channel extending through the threaded hole in a direction perpendicular to the axial direction. The bonding block also includes a screw assembly having a screw and a contacting element having a substantially flat first contact surface. The block body also includes a substantially flat second contact surface positioned at a bottom of the threaded hole and the ground wire channel. The screw assembly compresses a ground wire extending through the ground wire channel between the first contact surface and the second contact surface as the screw is tightened in the threaded hole.

In another aspect, the present disclosure is directed to an electrical connector for making electrical contact with a wire. The electrical connector includes a screw including a head at a proximal end of the screw, a threaded portion, and a non-threaded portion. The non-threaded portion includes a first section and a second section, the second section including a larger diameter than the first section and being formed at a distal end of the screw. The electrical connector also includes a contacting element attachable to the non-threaded portion of the screw and configured to rotate freely relative to the screw.

In yet another aspect, the present disclosure is directed to a method of manufacturing an electrical connector. The method includes providing a screw including a head at a proximal end of the screw, a threaded portion, and a non-threaded portion. The method also includes providing a contacting element including a substantially flat contact surface and a pair of attachment arms connected to the contact surface. The attachment arms each including a forked section. The method further includes attaching the contacting element to the screw by crimping the forked sections toward each other such that the non-threaded portion of the screw is received in the forked sections.

BRIEF DESCRIPTION OF THE DRAWING(S)

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENT(S)

The present disclosure relates to an electrical connector for making an electrical connection to a wire, such as a ground wire. In an exemplary embodiment, the disclosure relates to a bonding block for grounding a cable or wire. The bonding block includes a pair of connectors which expose the conductive portion of the cable or wire to connection to a ground wire. A portion of the bonding block is configured to receive a screw assembly which makes the electrical connection to the ground wire by compressing the wire between a contact surface of the screw assembly and a contact surface of the bonding block body.

Figure 1:
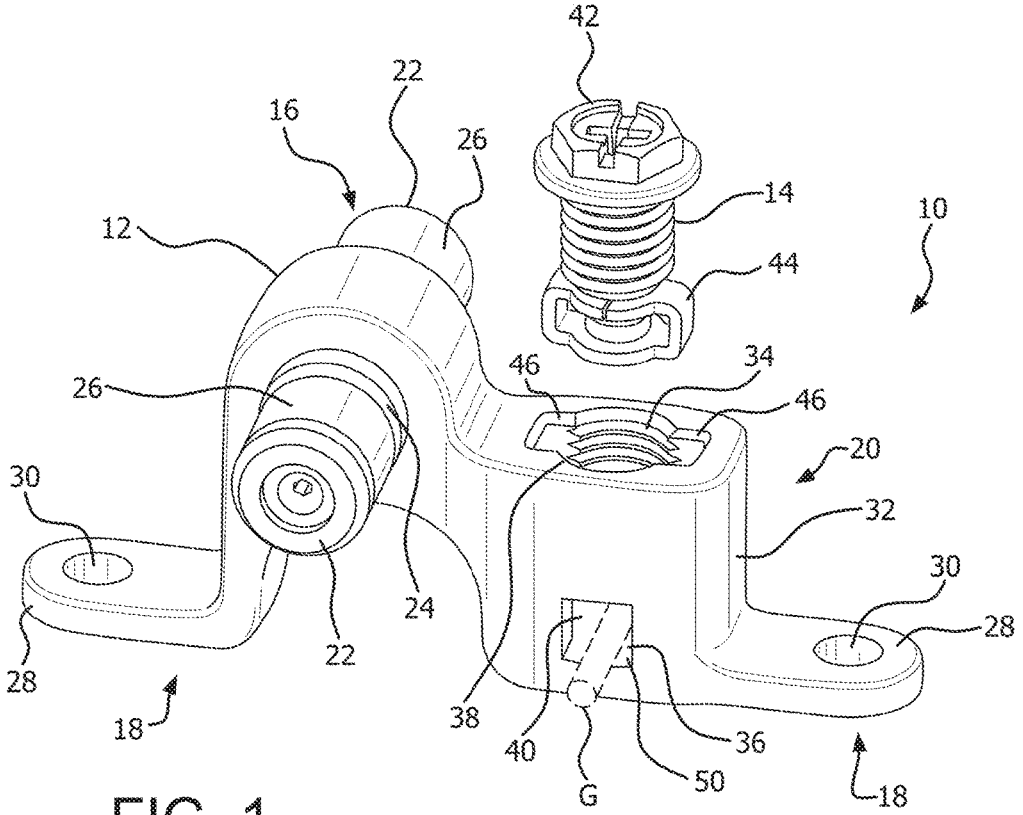
FIG. 1 is a perspective view of a bonding block according to an embodiment, including a screw assembly removed from the bonding block.
Figure 2:
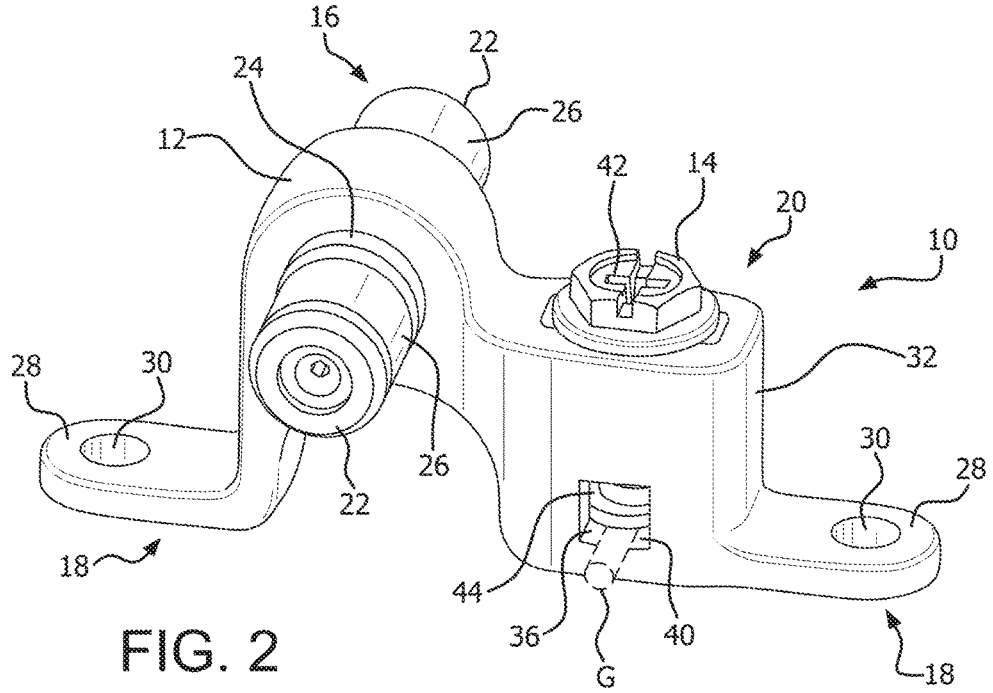
FIG. 2 is a perspective view of the bonding block according to the embodiment of FIG. 1, including the screw assembly installed on the bonding block.

FIGS. 1-2 illustrate a bonding block 10, according to an exemplary embodiment. At least some of the components which make up the bonding block 10 form an electrical connector which may be used to create an electrical connection to a wire, such as a grounding wire. The bonding block 10 includes a block body 12 and a screw assembly 14. As shown in FIG. 1, the screw assembly 14 is removable from the block body 12. FIG. 2 shows the screw assembly 14 in the block body 12. The block body 12 forms a structural support for the components of the bonding block 10. The block body 12 is formed from a suitable material and includes a cable connection portion 16, an attachment portion 18, and a ground wire connection portion 20. While a cable connection portion 16 is illustrated in the embodiment of FIGS. 1 and 2, one of ordinary skill in the art would readily understand that other wire connections can be used without departing from the spirit and scope of this disclosure.

The cable connection portion 16 includes, for example, a pair of coaxial cable connectors 22 at a coaxial junction 24. The coaxial cable connectors 22 are conventional connection mechanisms for being connected to incoming and outgoing coaxial cables (not shown). The coaxial cable connectors 22 include external threads 26 which are preferably grounded to the block body 12 to thereby provide grounding to a conductive portion (e.g., shield layer) of the connected coaxial cables. While a single coaxial junction 24 is shown, it should be understood that any number of coaxial cable connectors 22 may be provided for grounding via the bonding block 10.

The bonding block 10 is preferably configured to be attached to a structure. The structure may be a box, wall, poll, or any appropriate structure in the vicinity of the coaxial cable which is grounded by the bonding block 10. The attachment portion 18 facilitates attachment of the bonding block 10 to the structure. In an exemplary embodiment, the attachment portion 18 includes a pair of flanges 28 which contact a surface of the structure and corresponding holes 30 for receiving respective fasteners that attach the bonding block 10 to the structure.

The ground wire connection portion 20 is configured to work in conjunction with the screw assembly 14 to form a secure electrical connection to a grounding wire G. The block body 12 at the ground wire connection portion 20 includes a block portion 32 sized to accommodate the screw assembly 14 and the features described herein. In an exemplary embodiment, the block portion 32 includes a threaded hole 34 extending in an axial direction and a ground wire channel 36 extending through the threaded hole 34 in a direction perpendicular to the axial direction.

The threaded hole 34 is preferably formed near an upper portion of the block portion 32 which includes an opening 38 into the threaded hole 34. The ground wire channel 36 includes openings 40 on opposing sides of the block portion 32 in order to allow the ground wire G to pass through the ground wire channel 36 and a portion of the threaded hole 34. In this way the ground wire G is exposed to the screw assembly 14 when the screw assembly 14 is in the threaded hole 34.

As shown in FIG. 1, the screw assembly 14 includes a screw 42 and a contacting element 44. Where previous bonding blocks rely on the screw tip or head to create an electrical connection with the ground wire, the contacting element provides a more secure mechanism which compresses the ground wire G inside the ground wire channel 36 between substantially flat surfaces. As used herein, the term "compress" includes the application of a pressing force by a contact area and does not necessarily imply that the contacted element (e.g., ground wire G) deforms due to the force. The bonding block 10 is configured such that the contacting element 44 is easily lowered onto the ground wire G which runs through the ground wire channel 36. In order to achieve this functionality, the contacting element 44 is rotatable in relation to the screw 42. In this way, the screw 42 can be rotated in order to cause axial movement of the screw 42 and contacting element 44, without rotating the contacting element 44.

The screw assembly 14 is preferably formed as a combination component in which the screw 42 and the contacting element 44 are provided together and movable as one piece. For example, the contacting element 44 is preferably attached to the screw 42 prior to insertion into the threaded hole 34. The block body 12 is configured such that the screw assembly 14, including the contacting element 44 and a portion of the screw, is insertable into the opening 38 into the threaded hole 34.

In an exemplary embodiment, the block body 12 further includes one or more alignment channels 46 which receive a portion of the contacting element 44. The alignment channels 46 ensure proper radial alignment of the contacting element 44 inside the threaded hole 34 and ground wire channel 36. The alignment channels 46 match the shape of end portions of the contacting element 44 and thereby inhibit rotation of the contacting element 44 with respect to the block body 12. In this way, the contacting element 44 is configured to slide in an axial direction without rotation while the screw 42 is tightened. Tightening of the screw 42 leads to contact and compression of the ground wire G in this manner.

In an exemplary embodiment, the alignment channels 46 are rectangular extensions off of the circular threaded hole 34. It should be understood that other configurations are possible. For example, the alignment channels 46 may include a different shape or position with respect to the threaded hole 34, and/or could be more or less in number. In some embodiments, it is possible for the alignment channels 46 to be omitted. For example, the contacting element may be formed to include a diameter less than or approximately equal to the threaded hole 34.

Figure 3:
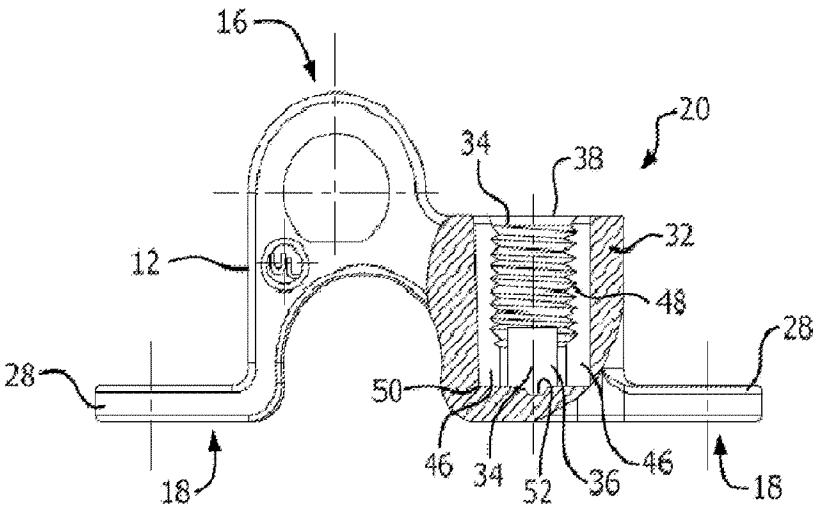
FIG. 3 is a cross-sectional view of the bonding block of FIGS. 1-2.
Figure 4:
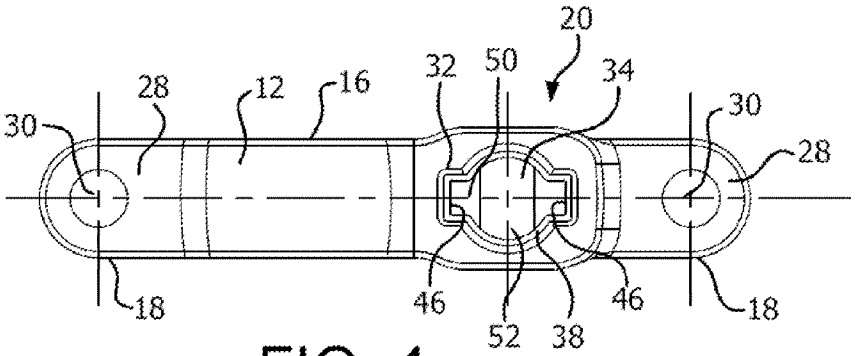
FIG. 4 is a top view of the bonding block of FIGS. 1-2.

FIGS. 3-4 further illustrate the exemplary embodiment of the block body 12. FIG. 3 is a cross-sectional view of the block body 12, showing the internal configuration of the threaded hole 34. As shown in FIG. 3, the threaded hole 34 includes a threaded portion 48 which extends, in one embodiment, from the opening 38 into the threaded hole 34 to the openings 40 of the ground wire channel 36. The openings 40 may extend into the threaded portion 48, or may be separated therefrom.

As shown in FIGS. 3-4, the block body 12 includes a contact surface 50. The contact surface 50 preferably forms a bottom of both the threaded hole 34 and the ground wire channel 36. The contact surface 50 is substantially flat and supports the ground wire G which runs through the ground wire channel 36. The contacts surface 50 is substantially flat in that it extends generally in a single direction or plane, but is not necessarily free from undulations or some curvature. For example, the contact surface 50 preferably includes a depression 52 which extends at the center of the contact surface 50 in the direction of the ground wire channel 36.

The depression 52 forms an area of increased surface area for contacting the ground wire G and at least partially cradles the ground wire G to spread the compression force around a circumference of the ground wire G.

Figure 5:
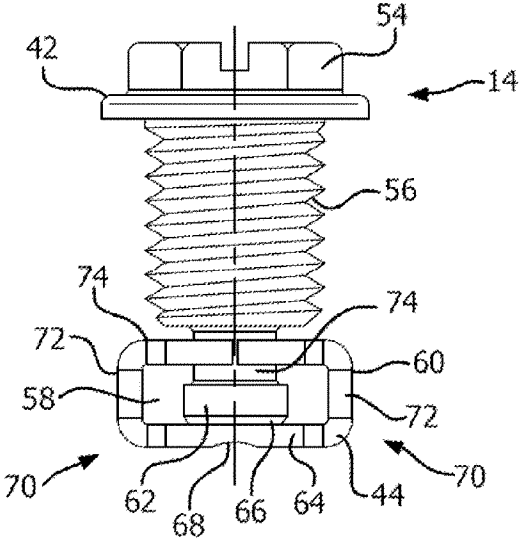
FIG. 5 is a side view of the screw assembly of FIGS. 1-2.

FIG. 5 further illustrates the screw assembly 14, including the screw 42 and the contacting element 44. The screw 14 preferably includes a head 54 at a proximal end of the screw 14, a threaded portion 56, and a non-threaded portion 58. The head 54 may be any conventional screw or bolt head, including a means for a tool (e.g., hex, flat, or Philips head screwdriver) to rotate the screw 42. The threaded portion 56 may be formed with conventional threading and be configured to mate with the threaded portion 48 of the threaded hole 34. The non-threaded portion 58 is formed at a distal end of the screw 42.

In an exemplary embodiment, the non-threaded portion 58 includes a first section 60 and a second section 62. The second section 62 preferably includes a larger diameter than the first section 60 and is formed at a distal end of the screw 42 (e.g., more distal than the first section 60). In this way, the second section 62 forms an end stop which inhibits the contacting element 44 from sliding off of the screw 42.

The contacting element 44 is attachable to the non-threaded portion 58 of the screw 42 and is preferably configured to rotate freely relative to the screw 42. The contacting element 44 includes a contact surface 64 which extends across an end surface 66 of the screw 42. The contact surface 64 is substantially flat and forms a surface for compressing the ground wire G against the contact surface 50 when the screw assembly 14 is tightened. The contact surface forms the bottom-most surface of the screw assembly 14 and is therefore lowered onto the ground wire G via axial movement of the screw 42.

The contact surface 64, much like the contact surface 50, is substantially flat in that it extends generally in a single direction or plane, but is not necessarily free from undulations or some curvature. For example, the contact surface 64 preferably includes a depression 68 which extends at the center of the contact surface 64 in the direction of the ground wire channel 36 (when the contacting element 44 is in the block body 12). The depression 68 forms an area of increased surface area for contacting the ground wire G and at least partially cradles the ground wire G to spread the compression force around a circumference of the ground wire G. The depression 68 is formed opposite the depression 52 such that both sides of the ground wire G are aligned and/or cradled. It should be understood, however, that alignment can be accomplished by only one of the depressions 52, 68, and, in some embodiments, only one of these features are provided. It should be further understood that the depressions 52, 68 may both be omitted in other embodiments (e.g., in the case of a very thin or flat grounding wire).

The contact surface 64 is connected to the non-threaded portion 58 of the screw 42 by a pair of attachment arms 70. The attachment arms 70 are connected to the contact surface 64 at ends thereof and are configured to attach the contacting element 44 to the screw 42. The attachment arms 70 each include a first portion 72 extending toward the head 54 of the screw 42 from the contact surface 64 and a second portion 74 extending toward the non-threaded portion 48 of the screw 42.

The contacting element 44 is preferably formed such that a distance between the first portions 72 (e.g., a length of the contact surface 64) of the attachment arms 70 is greater than a diameter of the threaded portion 56 of the screw 42. Moreover, relevant portions of the contact surface 64, first portions 72, and second portions 74 are shaped and positioned to match the shape of the alignment channels 44. In this way, the first portions 72 of the attachment arms 70 are configured to be received in the alignment channels 46 to non-rotatably guide the contacting element 44 as the screw 42 is tightened in the threaded hole 34.

Figure 6:
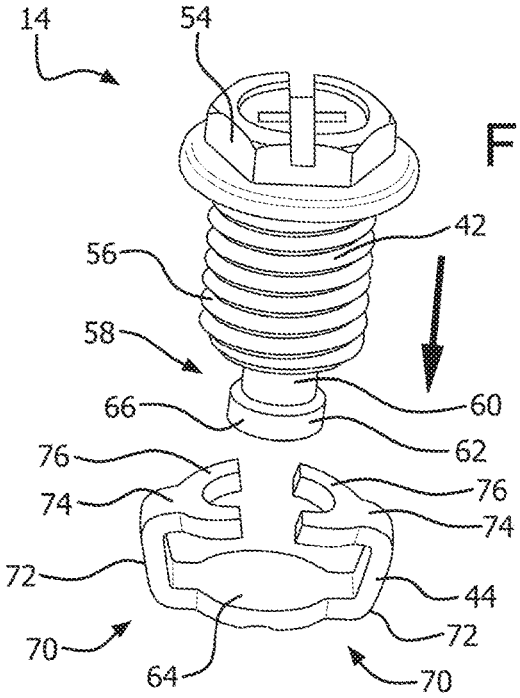
FIG. 6 is a perspective view of the screw assembly of FIG. 5, including an unattached contact element.
Figure 7:
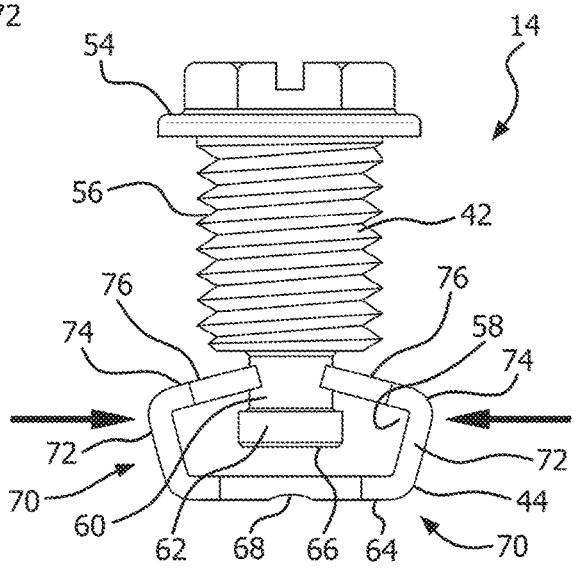
FIG. 7 is a side view of the screw assembly of FIG. 6 with the contact element in an intermediate position on a screw.
Figure 8:
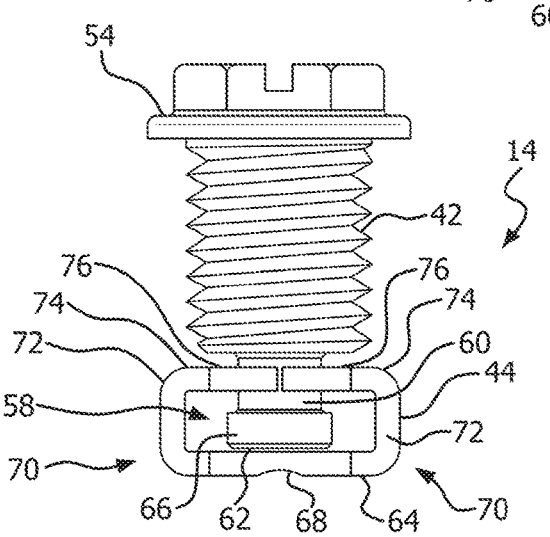
FIG. 8 is a side view of the screw assembly of FIG. 6 with the contact element in an installed position.

FIG. 6-8 illustrate an exemplary method for forming the screw assembly 14, including an exemplary process for attaching the contacting element 44 to the screw 42. As shown in FIG. 6, the second portions 74 of the attachment arms 70 extend toward each other. The second portions 74 include forked sections 76 which form a receiving area for the non-threaded portion 58 of the screw 42. As shown in FIG. 6, the first portions 72 are initially bent slightly away from each other such that the space between the forked sections 76 is large enough to allow the screw 42 to be moved into place with the first section 60 of the non-threaded portion 58 in between the forked sections 76 and the second section 62 of the non-threaded portion 58 axially between the contact surface 64 and the second sections 74 of the attachment arms 70.

After the screw 42 is positioned relative to the open contacting element 44, the attachment arms 70 are crimped toward each other such that the non-threaded portion 58 of the screw 42 is received in the forked sections 76, as shown in FIG. 7. For example, the section portions 74 of the attachment arms are moved toward each other until the first section 60 of the non-threaded portion 58 is captured in the forked sections 76.

In an exemplary embodiment, plastic deformation retains the forked sections 76 on the first section 60 of the non-threaded portion 58, as shown in FIG. 8, although other connection means are possible, such as spring biasing, adhesive, soldering, etc. The forked sections 76 may contact each other and/or the first section 60, but contact is not required. The contacting element 44 is preferably rotatable relative to the screw 42 and may be slidable in an axial direction along the first section 60. The second section 62 inhibits the contacting element 44 from sliding off of the screw 42.

Returning to FIGS. 1-2, with the contacting element 44 attached to the screw 42, the screw assembly 14 is prepared to be attached to the block body 12 to create an electrical connection to the ground wire G. The ground wire G is inserted through the ground wire channel 36 and rests on the contact surface 50 (e.g., in the depression 52). The screw assembly 14 is inserted into the threaded hole 34 by aligning the contacting element 44 with the alignment channels 46.

The screw 42 is tightened to cause axial movement of the screw 42 and contacting element 44 until the contact surface 64 contacts the opposite side of the ground wire G. Tightening may continue until the contacting element 44 slides up the first section 60 of the non-threaded portion 58 and an opposite side of the contact surface 64 abuts the end surface 66 of the screw 42. The ground wire G is thereby compressed between the substantially flat contact surfaces 50, 64, creating a secure electrical connection with the block body 14 and coaxial junction 24, thereby grounding a selected portion of an attached coaxial wire.

The disclosed bonding block is described in relation to grounding a coaxial wire, but it should be understood that various features may be used in other embodiments to create other electrical connections to wires (e.g., wires which are not ground wires). The disclosed electrical connector provides a secure connection mechanism which does not rely on a component of a conventional screw itself to make contact with the wire, which may not be reliable and/or may not meet acceptable standards for some configurations. The combination of the screw and the contacting element being attached to each other prior to insertion in the threaded hole simplifies the assembly process. In particular, an additional process step of connecting the contacting element to the screw after the screw is inserted is not necessary and it is difficult for the contacting element to be misplaced. The disclosed features provide a cost-effective and easy-to-use configuration for improving over the conventional methods by providing several intuitive alignment features and by implementing movable and compressive contacting element which creates a secure electrical connection.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A bonding block, comprising:

a block body;

a threaded hole defined in the block body and extending in an axial direction;

a ground wire channel that extends through the threaded hole in a direction perpendicular to the axial direction; and a screw assembly configured to be insertable into the threaded hole, the screw assembly comprising a screw and a contacting element, wherein the contacting element includes a pair of attachment arms that form a first contact surface of the contacting element and each of the pair of the attachment arms includes a forked portion that attaches the contacting element to a non-threaded portion of the screw so that the contacting element is able to rotate freely relative to the screw, wherein the block body includes a substantially flat second contact surface positioned at a bottom of the threaded hole and the ground wire channel, and wherein the screw assembly is configured to compress a ground wire extending through the ground wire channel between the first contact surface and the second contact surface as the screw is tightened in the threaded hole.

2. The bonding block of claim 1, further comprising a coaxial junction including at least one pair of coaxial cable connectors.

3. The bonding block of claim 2, wherein the coaxial junction is grounded to the block body.

4. The bonding block of claim 1, wherein at least one of the first contact surface and the second contact surface include a depression for receiving the ground wire.

5. The bonding block of claim 4, wherein both the first contact surface and the second contact surface include a respective depression for receiving the ground wire.

6. The bonding block of claim 1, wherein the block body is securable to a structure.

7. The bonding block of claim 1, wherein the contacting element is configured to slide in the axial direction along the screw while the screw rotates relative to the contacting element when the screw is tightened in the threaded hole.

8. The bonding block of claim 7, further comprising at least one guide channel extending in the axial direction adjacent to the threaded hole for guiding the contacting element in the axial direction and preventing the contacting element from rotating with the screw when the screw is tightened in the threaded hole.

9. The bonding block of claim 8, wherein the at least one guide channel includes a pair of guide channels on opposing sides of the threaded hole.

10. An electrical connector for making electrical contact with a wire, comprising:

a screw including a head at a proximal end of the screw, a threaded portion, and a non-threaded portion, wherein the non-threaded portion includes a first section and a second section, the second section including a larger diameter than the first section and being formed at a distal end of the screw;

a contacting element including a pair of attachment arms that form a first contact surface of the contacting element and each of the pair of the attachment arms includes a forked portion that attaches to the non-threaded portion of the screw so that the contacting element is able to rotate freely relative to the screw.

11. The electrical connector of claim 10, wherein the first contacting surface is a substantially flat contact surface which extends across an end surface of the screw.

12. The electrical connector of claim 11, wherein the pair of attachment arms each include a first portion extending toward the head from the first contact surface and a second portion extending toward the non-threaded portion of the screw.

13. The electrical connector of claim 12, wherein a distance between the first portion of each of the pair of attachment arms is greater than a diameter of the threaded portion of the screw.

14. The electrical connector of claim 13, further comprising a body having a threaded hole for receiving the screw, a channel for receiving a ground wire, and a second contact surface that is substantially flat contact and formed at a bottom of the threaded hole and the channel, wherein body is configured such that the ground wire is compressed between the first contact surface and the second contact surface when the screw is tightened in the threaded hole.

15. The electrical connector of claim 14, wherein the body includes a pair of guide channels extending in same direction as the threaded hole and receiving the first portion of each of the pair of attachment arms to non-rotatably guide the contacting element as the screw is tightened in the threaded hole.

16. A method of making an electrical connector comprising:

providing a screw including a head at a proximal end of the screw, a threaded portion, and a non-threaded portion including an end stop;

providing a contacting element including a substantially flat contact surface and a pair of attachment arms connected to the contact surface, the attachment arms each including a forked section; and attaching the contacting element to the screw by crimping the attachment arms toward each other such that the non-threaded portion of the screw is received in the forked section of each of the attachment arms;

wherein the end stop includes a diameter greater than an opening formed by the forked section of each of the attachment arms after the contacting element is crimped for inhibiting the contacting element from sliding off of the screw.

17. The method of claim 16, wherein the contacting element is rotatable relative to the screw after the contacting element is crimped.

18. The method of claim 16, wherein the electrical connector is dimensioned to be inserted into a threaded hole of a block body to secure a ground wire to the block body.

* * * * *